US006915594B2

(12) United States Patent
Kim

(10) Patent No.: US 6,915,594 B2
(45) Date of Patent: Jul. 12, 2005

(54) AIR CUSHION SHOE FOR INDOOR EXERCISE

(75) Inventor: Chang Ho Kim, #30 Haegang Heights Villa, 68 Daesung-dong, Kimhae-si, Kyungsangnam-do (KR)

(73) Assignees: Busan Techno-Park, Busan (KR); Chang Ho Kim, Kyungsangnam-do (KR)

( * ) Notice: Subject to any disclaimer, the term of this patent is extended or adjusted under 35 U.S.C. 154(b) by 101 days.

(21) Appl. No.: 10/647,082

(22) Filed: Aug. 21, 2003

(65) Prior Publication Data

US 2004/0194343 A1 Oct. 7, 2004

(30) Foreign Application Priority Data

Apr. 2, 2003 (KR) ..... 20-2003-0009922
Jul. 16, 2003 (KR) ..... 20-2003-0023061

(51) Int. Cl.[7] ..... A43B 13/20
(52) U.S. Cl. ..... 36/29
(58) Field of Search ..... 36/29, 28, 35 B, 36/3 B

(56) References Cited

U.S. PATENT DOCUMENTS 4,319,412 A * 3/1982 Muller et al. ..... 36/29
4,547,978 A * 10/1985 Radford ..... 36/3 B
5,598,645 A * 2/1997 Kaiser ..... 36/29
5,679,439 A * 10/1997 Schmidt et al. ..... 36/29
6,009,637 A * 1/2000 Pavone ..... 36/29
6,266,897 B1 * 7/2001 Seydel et al. ..... 36/29

* cited by examiner

*Primary Examiner*—Ted Kavanaugh
(74) *Attorney, Agent, or Firm*—Lee, Hong, Degerman, Kang & Schmadeka

(57) ABSTRACT

Disclosed is an air cushion shoe with various kinds of air chambers capable of absorbing the shocks generated by the application of the weight of a wearer in a vertical direction and distributing the absorbed shocks in a horizontal direction. The air cushion shoe of this invention has an upper and a sole, including a group of air chambers protrudedly exposed on the bottom surface of the sole of the shoe, the group of air chambers having a single air chamber that is located on the heel portion of the sole and divided into a first single air chamber and a second single air chamber by means of a partition and having plural kinds of communicating air chambers that are located on the whole portion except the heel portion of the sole, wherein the single air chamber is separated from the plural kinds of communicating air chambers.

5 Claims, 8 Drawing Sheets

AIR CUSHION SHOE FOR INDOOR EXERCISE

BACKGROUND OF THE INVENTION

1. Field of the Invention

The present invention relates to an air cushion shoe with various kinds of air chambers capable of absorbing the shocks generated by the application of the weight of a wearer in a vertical direction and distributing the absorbed shocks in a horizontal direction.

More particularly, the present invention relates to an air cushion shoe for indoor exercise with a group of air chambers that are protruded on the bottom surface of a sole of the shoe, having a single air chamber located on the heel portion of the shoe sole, the single air chamber partitioned into a first single air chamber and a second single air chamber, and having plural kinds of communicating air chambers located on the whole portion except the heel portion of the shoe sole, the plural kinds of communicating air chambers arranged in the order of large-sized ones, middle-sized ones, small-sized ones, and very smaller-sized ones from the back section to the front section thereof except the heel portion of the sole and communicating with one another in a radical direction, each communicating air chamber provided with a concave/convex part on the bottom surface thereof.

2. Background of the Related Art

Air cushion shoes are generally known comprising a substantially cylindrical tube or a closed air tube into which air or gas is filled that is put and fixed in the heel portion of the shoe so as to absorb the shocks generated by the application of the weight of a wearer in a vertical direction. The development of such the air cushion shoes is caused by the fact that when a human walks or runs, his or her heel portion first comes in contact with the ground. In addition thereto, recently, there have been introduced new shoes for giving finger-pressure like effect to the soles of feet.

Furthermore, there have been presented a shoe having an air chamber on the whole portion of the shoe sole so as to make a wearer feel comfortable and give improved stability and balance to the shoe, which is disclosed in Korean Patent No. 248539 entitled 'Air cushion device for shoe', as shown in FIG. 1. As illustrated, the conventional air cushion device is comprised of a plurality of air chambers in the interior of an air cushion plate on the sole having a flat bottom surface, an elastic intermediate plate placed on the air cushion plate, and a pressure buffering plate placed on the intermediate plate, having pressure buffering protrusions.

In this prior art, one air chamber's air resistance force against the portion where a wearer's weight is first applied is sent to another air chamber as soon as possible, such that the shock applied to the foot is distributed and absorbed. This enables the fatigue of the foot to be reduced and also enables the shock applied to the wearer's back to be minimized. However, the bottom surface of the sole is designed flat, so it may be often slippery.

Another example of the prior arts is disclosed in Korean Utility Model Registration No. 159978 entitled 'Air cushion shoe sole giving finger-pressure like effect', as shown in FIG. 2. As illustrated, the sole comprises a plurality of air chambers in the interior of the sole having a flat surface, wherein the side air chambers are in communication with one another, but the front and back air chambers are not in communication with one another. In this prior art, one air chamber's air resistance force against the portion where a wearer's weight is first applied is sent to another side air chamber as soon as possible, but is not sent to any front or back one, which results in the failure of the smooth distribution of the shock applied to the foot. So, the reduction of the fatigue of the foot and the shock absorption for the back couldn't be achieved. Moreover, it may be slippery because the bottom of the sole is flat.

As another example of the prior arts, there is disclosed Japanese Patent laid-open Publication No. Hei 5-309001 entitled 'A shoe sole', which is illustrated in FIG. 3. In this case, the sole comprises a plurality of protrusions that are formed to maximize a force of friction, on the bottom surface thereof, so that the shoe is not slippery. However, since the air chambers are located in the interior of the sole of the shoe on the upper portion of the protrusions, such a conventional sole is somewhat problematic in minimizing its elastic rebounding force relative to the shock applied thereto.

As another example of the prior arts, there is disclosed in European Patent No. 301331 entitled 'Air cushion shoe', as shown in FIG. 4, which comprises a plurality of air chambers in the interior of the sole of the shoe. Therefore, such a conventional air cushion shoe is somewhat problematic in minimizing its elastic rebounding force relative to the shock applied to the sole thereof like air cushion shoe sole of the Korean Utility Model Registration No. 159978. This prior art still has the same disadvantages as the above-mentioned conventional practices.

SUMMARY OF THE INVENTION

Accordingly, the present invention is directed to an air cushion shoe for indoor exercise that substantially obviates one or more problems due to limitations and disadvantages of the related art.

An object of the present invention is to provide an air cushion shoe for indoor exercise that is provided with a group of air chambers protrudedly exposed on the bottom surface of the sole of the shoe so as to absorb the shock generated by the application of the weight of a wearer in a vertical direction, the group of air chambers comprising a single air chamber located on the heel portion of the sole and plural kinds of communicating air chambers located on the whole portion except the heel portion of the sole in such a manner as to be separated from the single air chamber, thereby making a wearer feel comfortable and giving improved stability and balance to the shoe, wherein one air chamber's air resistance force against the portion where a wearer's weight is first applied is sent to another air chamber as soon as possible, such that the shock applied to the foot is distributed and absorbed, which enables the fatigue of the foot to be reduced and also enables the shock applied to the wearer's back to be minimized.

Another object of the present invention is to provide an air cushion shoe for indoor exercise that is provided with plural kinds of communicating air chambers that are protrudedly exposed on the bottom surface of the sole, each communicating air chamber providing a concave/convex part on the bottom surface thereof, whereby during taking exercise a wearer does not slip by the friction of the communicating air chambers themselves and the friction of the concave/convex part.

Still another object of the present invention is to provide an air cushion shoe for indoor exercise that is provided with an air ventilation part that is located between adjacent communicating air chambers, the air ventilation part and the bottom surface of the sole having a substantially low thickness so that air flow is smoothly allowed toward the air ventilation part, whereby such the air flow through the air ventilation part makes the interior of the shoe greatly refreshed with the cool air.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

According to the above objects of the present invention, as embodied and broadly described herein, there is provided an air cushion shoe for indoor exercise having an upper and a sole, the air cushion shoe including: a group of air chambers protrudedly exposed on the bottom surface of the sole of the shoe, the group of air chambers having a single air chamber that is located on the heel portion of the sole and divided into a first single air chamber and a second single air chamber by means of a partition and having plural kinds of communicating air chambers that are located on the whole portion except the heel portion of the sole, wherein the single air chamber is separated from the plural kinds of communicating air chambers.

Preferably, the plural kinds of communicating air chambers are arranged in the order of large-sized ones, middle-sized ones, small-sized ones, and very smaller-sized ones from the back section to the front section thereof except the heel portion of the sole of the shoe, wherein the plural kinds of communicating air chambers are spaced at appropriate intervals in every direction and communicate with one another in a radical direction, each of the plural kinds of communicating air chambers provided with a concave/convex part on the bottom surface thereof.

In the preferred embodiment of the present invention, the number of the kinds of communicating air chambers is set four, but it may be varied depending upon their size. In the preferred embodiment of the present invention, furthermore, the sizes of the communicating air chambers are decreased sequentially, but they may be freely determined depending upon the size of a foot or its purpose for use.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
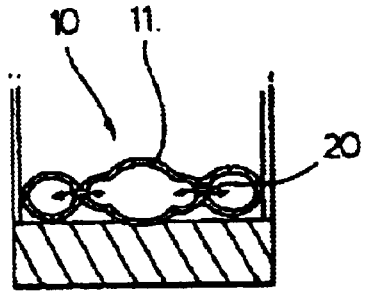
FIG. 1 Prior Art
FIG. 1 is a sectional view of a conventional air cushion shoe.
Figure 2:
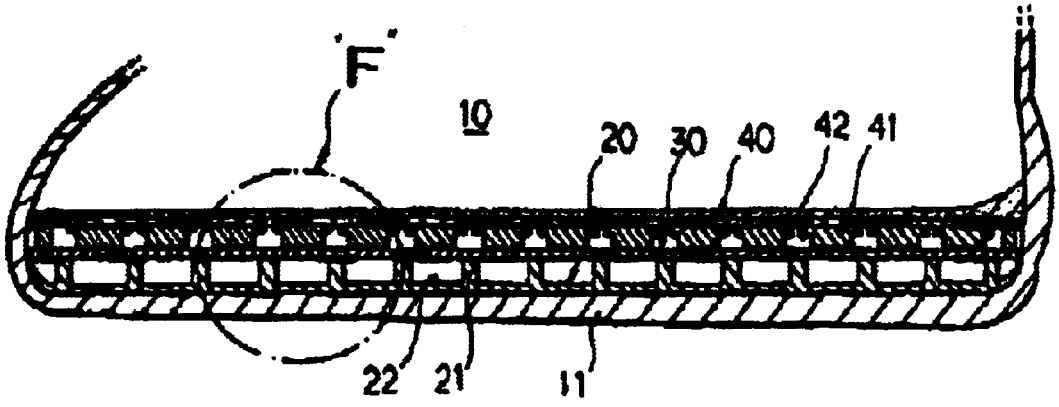
FIG. 2 Prior Art
FIG. 2 is a sectional view of another conventional air cushion shoe.
Figure 3:
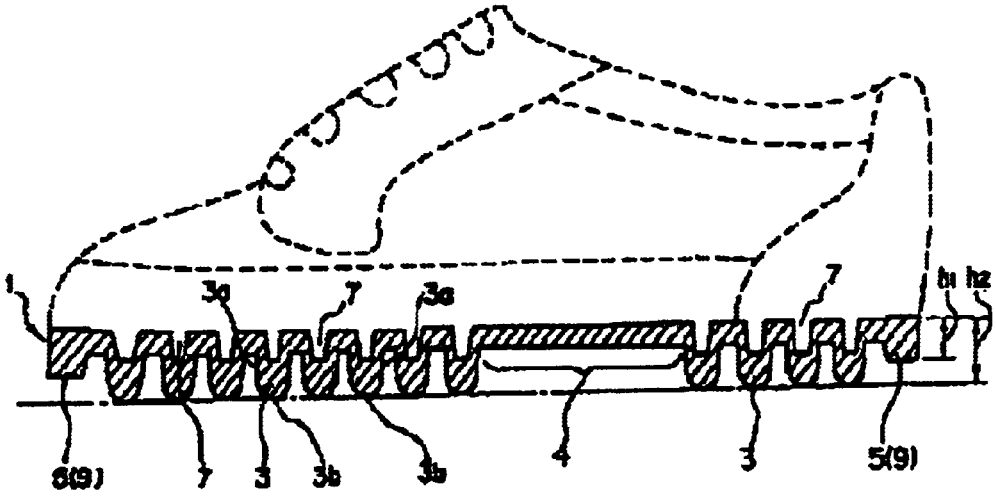
FIG. 3 Prior Art
FIG. 3 is a sectional view of yet another conventional air cushion shoe.
Figure 4:
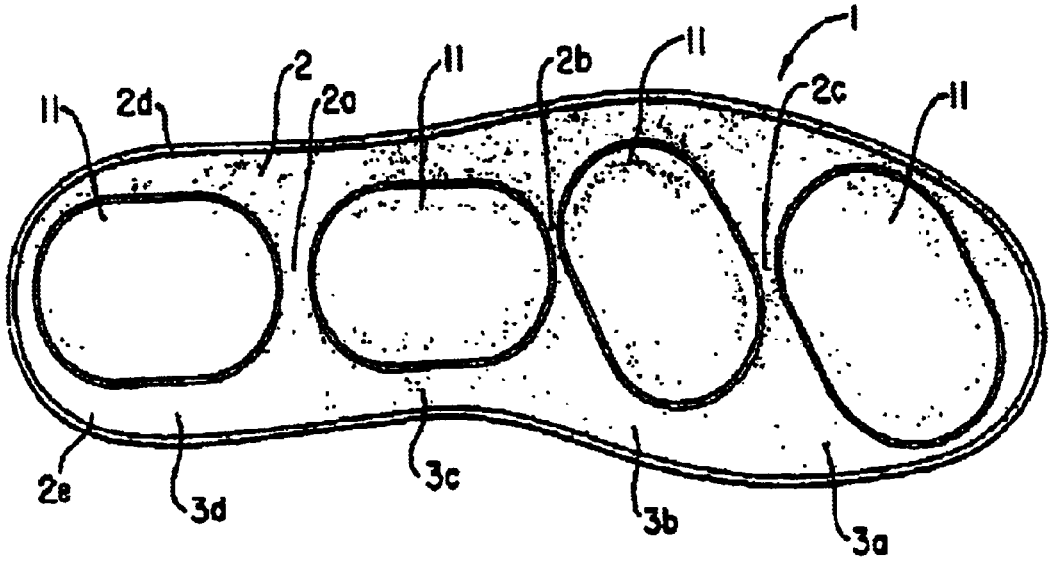
FIG. 4 Prior Art
FIG. 4 is a bottom view of yet still another conventional air cushion shoe.
Figure 5:
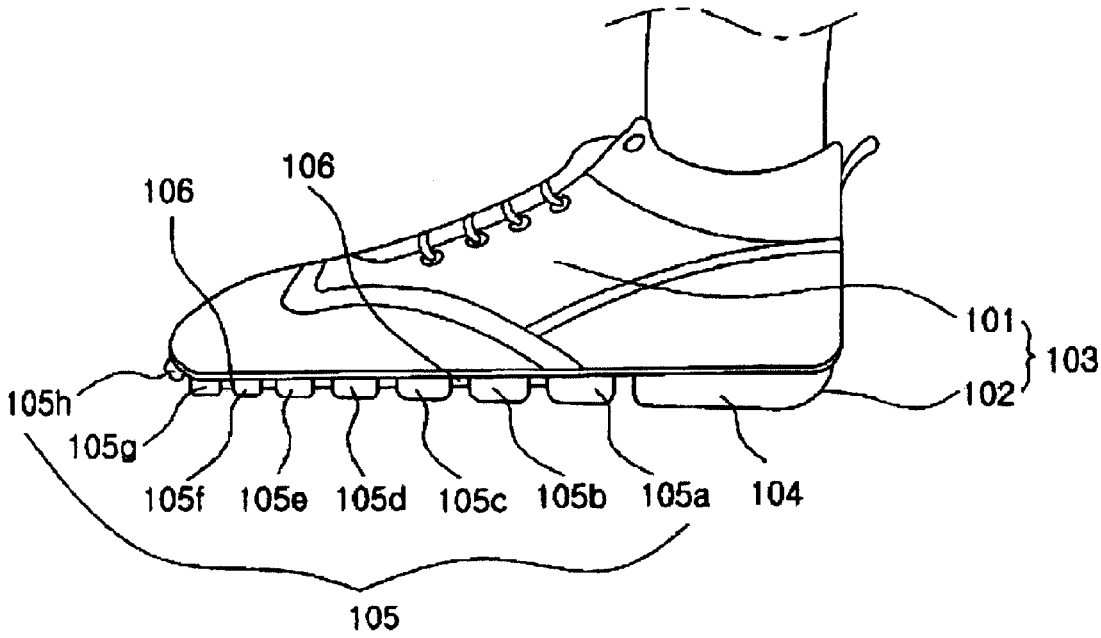
FIG. 5 is a front view of an air cushion shoe for indoor exercise according to the present invention.
Figure 6:
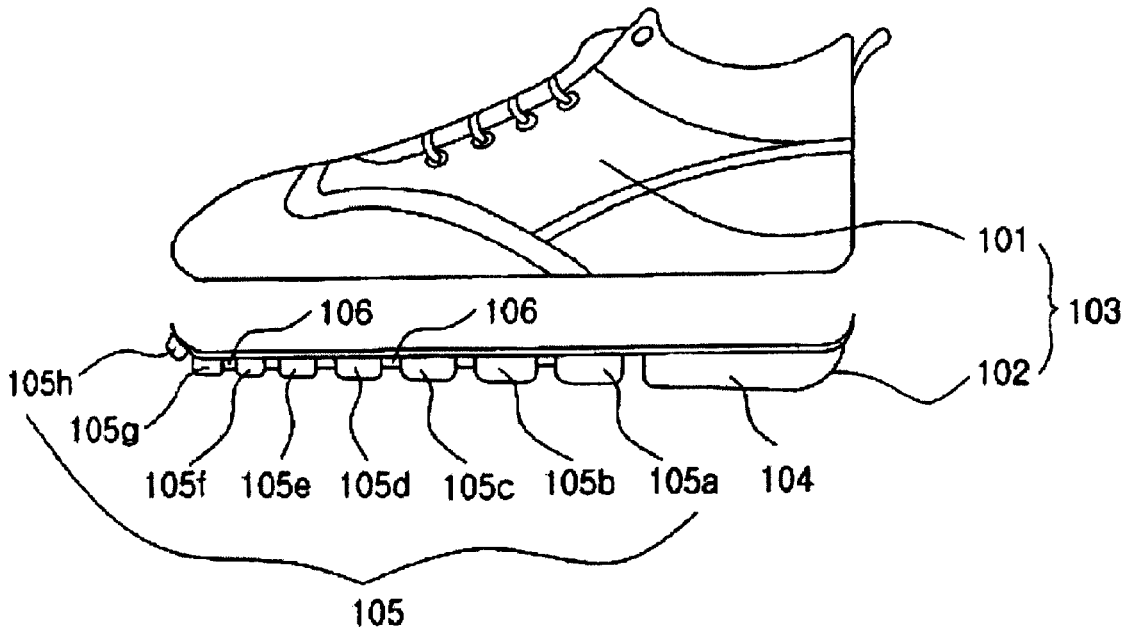
FIG. 6 is a front view of the upper and the sole separated from each other in the air cushion shoe of this invention.
Figure 7:
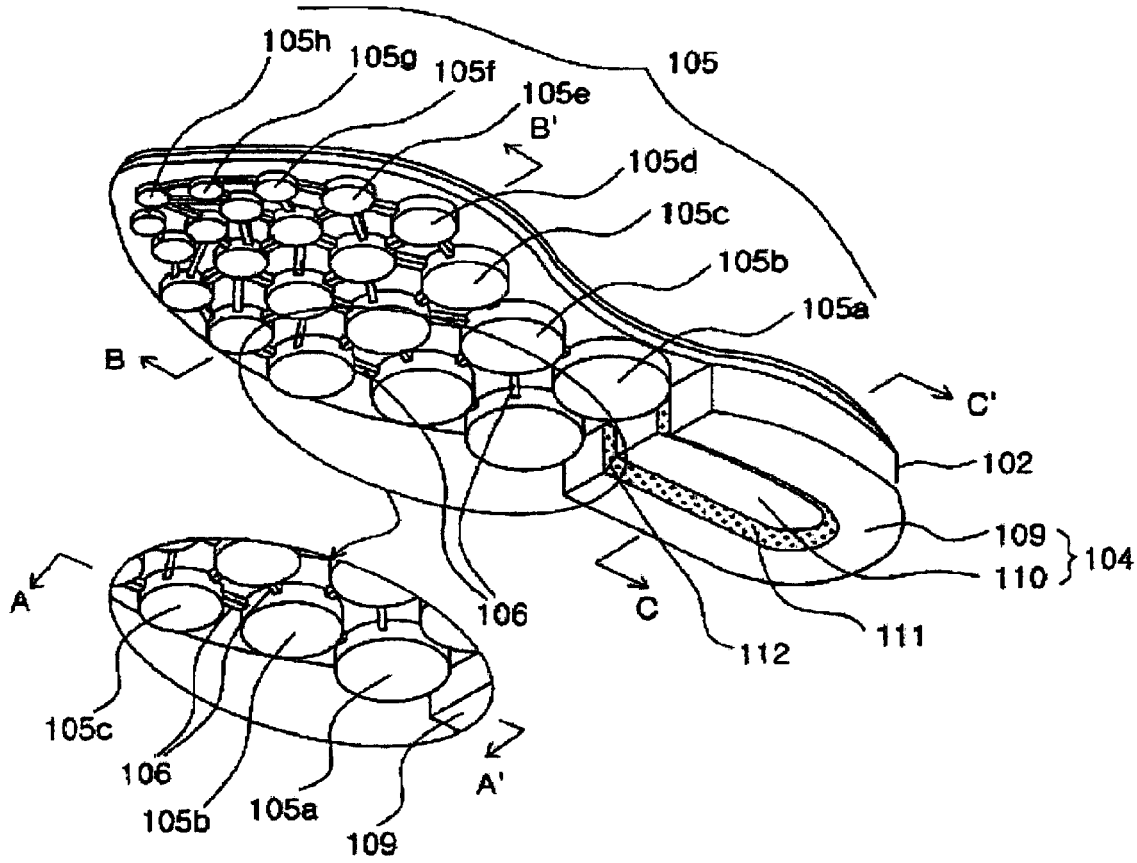
FIG. 7 is a perspective view of the group of air chambers located on the bottom surface of the sole in the air cushion shoe of this invention.
Figure 8:
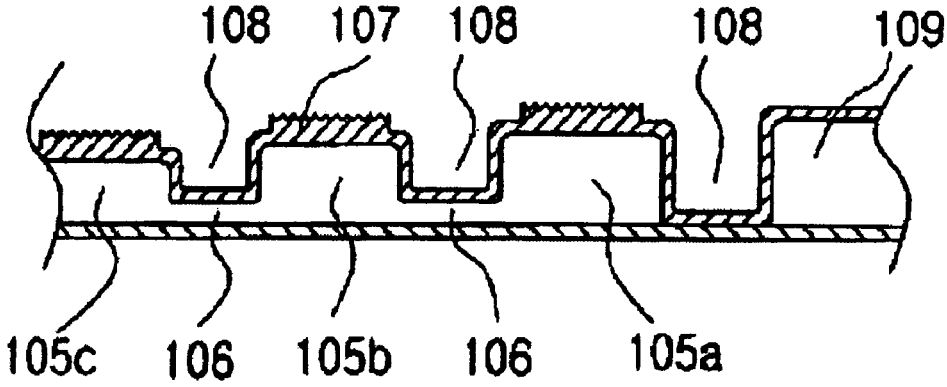
FIG. 8 is a sectional view taken along the line A–A' of FIG. 7.
Figure 9:
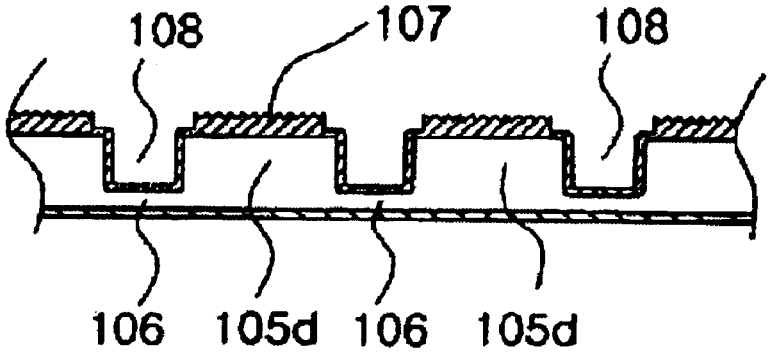
FIG. 9 is a sectional view taken along the line B–B' of FIG. 7.
Figure 10:
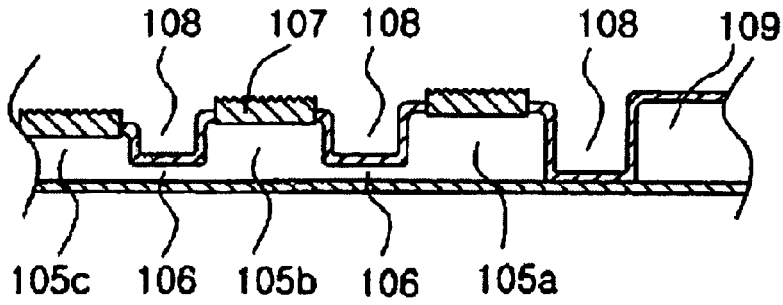
FIG. 10 is a sectional view taken along the line C–C' of FIG. 7.
Figure 11:
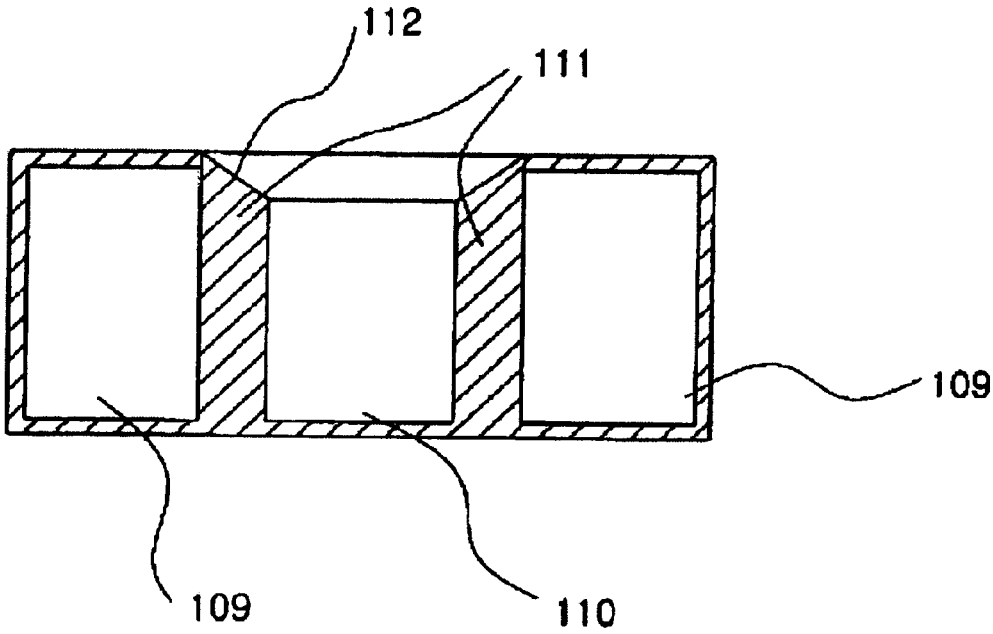
FIG. 11 is a sectional view of another example of the air chambers located on the bottom surface of the sole in the air cushion shoe of this invention.

FIG. 5 is a front view of an air cushion shoe for indoor exercise according to the present invention. FIG. 6 is a front view of the upper and the sole separated from each other in the air cushion shoe of this invention. FIG. 7 is a perspective view of the air chamber located on the bottom surface of the sole in the air cushion shoe of this invention. FIG. 8 is a sectional view taken along the line A–A' of FIG. 7. FIG. 9 is a sectional view taken along the line B–B' of FIG. 7.

Now, an explanation of the configuration of the air cushion shoe for indoor exercise according to the present invention will be given with reference to FIGS. 7 and 8.

According to the preferred embodiment of the present invention, there is provided the air cushion shoe 103 for indoor exercise having an upper 101 and a sole 102, the air cushion shoe 103 including: a group of air chambers protrudedly exposed on the bottom surface of the sole 102 of the shoe 103, the group of air chambers having a single air chamber 104 that is located on the heel portion of the sole and divided into a first air chamber 109 and a second air chamber 110 by means of a partition 111 and having plural kinds of communicating air chambers 105 that are located on the whole portion except the heel portion of the sole 102, wherein the single air chamber 104 is separated from the plural kinds of communicating air chambers 105.

Particularly, the first single air chamber 109 of the single air chamber 104 is protruded higher than the second single air chamber 110, while having an angle of a taper 112, such that shock absorption is first achieved by the first single air chamber 109 and is then achieved by the second single air chamber 110.

The plural kinds of communicating air chambers 105 are arranged in the order of large-sized ones 105*a*, middle-sized ones 105*b*, small-sized ones 105*c*, very smaller-sized ones 105*d* and the smallest-sized ones 105*h* from the back section to the front section thereof except the heel portion of the sole of the shoe, wherein the plural kinds of communicating air chambers 105 are spaced at appropriate intervals in every direction and have respective communicating holes 106 through which they communicate with one another in a radical direction, each of the plural kinds of communicating air chambers 105 provided with a concave/convex part 107 on the bottom surface thereof.

The concave/convex part 107 is formed by molding the same material as the sole 102 as an integral body with the sole 102 or by compression molding rubber different from the sole 102.

The concave/convex part 107 that is made of rubber on the bottom surface of each communicating air chamber makes a force of friction improved so as to prevent a wearer from slipping during taking tough exercise.

Moreover, the plural kinds of communicating air chambers 105 and the communicating holes 106 are protruded to a predetermined height from the bottom surface of the sole 102 of the shoe 103, wherein the plural kinds of communicating air chambers 105 are formed higher than the communicating holes 106 connected in the radical direction, such that there is an air ventilation part 108 between the adjacent communicating air chambers 105.

Now, an explanation of the operation of the air cushion shoe for indoor exercise according to the present invention will be given.

While a wearer is exercising, the pressure of air that is kept at a substantially parallel state to the communicating air chambers on the heel portion of the foot first touched on the ground is immediately distributed in a horizontal direction to the adjacent communicating air chambers through the communicating holes arranged in the radical direction relative to the communicating air chambers. That is, the pressure in the communicating air chambers under the application of the weight of the wearer in the vertical direction is directly delivered to the adjacent communicating air chambers through the communicating holes, such that a force of elastic rebounding relative to the application of the weight of the wearer in the vertical direction becomes reduced. In addition, the bottom surfaces of the communicating air chambers are provided with the concave/convex parts, such that the wearer does not slip during taking exercise. The formation of the air ventilation part between the adjacent communicating air chambers allows the air flow to be smoothly achieved, such that the wearer feels that his or her feet get cool.

As clearly discussed above, the air cushion shoe for indoor exercise of this invention can immediately distribute in a horizontal direction the pressure of air that is kept at a substantially parallel state to the communicating air chambers on the heel portion of the foot first touched on the ground to the adjacent communicating air chambers through the communicating holes arranged in the radical direction relative to the communicating air chambers. That is, the pressure in the communicating air chambers under the application of the weight of the wearer in the vertical direction is directly delivered to the adjacent communicating air chambers through the communicating holes, such that a force of elastic rebounding with reference to the portion of the foot first touched on the ground becomes reduced, which means the shocks applied to the foot are all absorbed. As the shocks applied to the foot are momentarily distributed in the horizontal direction, this prevents the wearer from slipping. This is also ensured by the facts that the communicating air chambers are protrudedly exposed on the bottom surface of the sole of the shoe and the bottom surfaces of the communicating air chambers are provided with the concave/convex parts.

What is claimed is:

1. An air cushion shoe for indoor exercise having an upper and a sole, said air cushion shoe comprising:

a group of air chambers protrudedly exposed on the bottom surface of said sole, said group of air chambers comprising a single air chamber located on the heel portion of said sole and divided into a first single air chamber and a second single air chamber by means of a partition and plural kinds of communicating air chambers located on the whole portion except said heel portion of said sole, wherein said single air chamber is separated from said plural kinds of communicating air chambers.

2. The air cushion shoe according to claim 1, wherein said plural kinds of communicating air chambers are arranged in the order of large-sized ones, middle-sized ones, small-sized ones, and very smaller-sized ones from the back section to the front section thereof except said heel portion of said sole, said plural kinds of communicating air chambers spaced at appropriate intervals in every direction and having respective communicating holes through which said plural kinds of communicating air chamber communicate with one another in a radical direction, each of said plural kinds of communicating air chambers provided with a concave/convex part on the bottom surface thereof.

3. The air cushion shoe according to claim 2, wherein said concave/convex part is formed by molding the same material as said sole as an integral body with said sole or by compression molding rubber different from said sole.

4. The air cushion shoe according to claim 1, wherein said plural kinds of communicating air chambers and said communicating holes are protruded to a predetermined height from the bottom surface of said sole of said shoe, wherein said plural kinds of communicating air chambers are formed higher than said communicating holes connected in the radical direction, such that there is an air ventilation part between the adjacent communicating air chambers.

5. The air cushion shoe according to claim 2, wherein said plural kinds of communicating air chambers and said communicating holes are protruded to a predetermined height from the bottom surface of said sole of said shoe, wherein said plural kinds of communicating air chambers are formed higher than said communicating holes connected in the radical direction, such that there is an air ventilation part between the adjacent communicating air chambers.

* * * * *